United States Patent [19]

Gorbaty et al.

[11] 4,227,989

[45] Oct. 14, 1980

[54] LIQUEFACTION OF CALCIUM-CONTAINING SUBBITUMINOUS COALS AND COALS OF LOWER RANK

[75] Inventors: Martin L. Gorbaty, Sanwood, N.J.; John W. Taunton, Seabrook, Tex.

[73] Assignee: Exxon Research & Engineering Co., Florham Park, N.J.

[21] Appl. No.: 798,663

[22] Filed: May 19, 1977

[51] Int. Cl.[2] ..... C10G 1/00; C10G 1/06; C10L 0/00

[52] U.S. Cl. ..... 208/8 LE; 208/10; 44/1 R

[58] Field of Search ..... 208/8, 10; 44/1 R; 252/425

[56] References Cited

U.S. PATENT DOCUMENTS

| | | | |
|---|---|---|---|
| 2,191,156 | 2/1940 | Pier et al. | 208/10 |
| 3,532,617 | 10/1970 | Hodgson | 208/10 |
| 3,729,407 | 4/1973 | Camp et al. | 208/10 |
| 3,755,137 | 8/1973 | Schuman | 208/10 |
| 3,796,650 | 3/1974 | Urban | 208/10 |
| 3,813,329 | 5/1974 | Gatsis | 208/8 |
| 4,039,473 | 8/1977 | Schafer | 252/425 |
| 4,054,420 | 10/1977 | Longanbach | 44/1 |
| 4,057,484 | 11/1977 | Malek | 208/8 |
| 4,057,512 | 11/1977 | Vadonic et al. | 252/413 |
| 4,060,478 | 11/1977 | Lang | 208/8 |
| 4,092,125 | 5/1978 | Stambaugh et al. | 44/15 R |

FOREIGN PATENT DOCUMENTS 457198 11/1936 United Kingdom .

*Primary Examiner*—Delbert E. Gantz
*Assistant Examiner*—William G. Wright
*Attorney, Agent, or Firm*—L. A. Proctor; Wayne Hoover

[57] ABSTRACT

A process for the treatment of a calcium-containing subbituminous coal and coals of lower rank to form insoluble, thermally stable calcium salts which remain within the solids portions of the residue on liquefaction of the coal, thereby suppressing the formation scale, made up largely of calcium carbonate deposits, e.g., vaterite, which normally forms within the coal liquefaction reactor (i.e., coal liquefaction zone), e.g., on reactor surfaces, lines, auxiliary equipment and the like. A solution of a compound or salt characterized by the formula MX, where M is a Group IA metal of the Periodic Table of the Elements, and X is an anion which is capable of forming water-insoluble, thermally stable calcium compounds, is maintained in contact with a particulate coal feed sufficient to impregnate said salt or compound into the pores of the coal. On separation of the impregnated particulate coal from the solution, the coal can be liquefied in a coal liquefaction reactor (reaction zone) at coal liquefaction conditions without significant formation of vaterite or other forms of calcium carbonate on reactor surfaces, auxiliary equipment and the like; and the Group IA metal which remains within the liquefaction bottoms catalyzes the reaction when the liquefaction bottoms are subjected to a gasification reaction.

15 Claims, 1 Drawing Figure

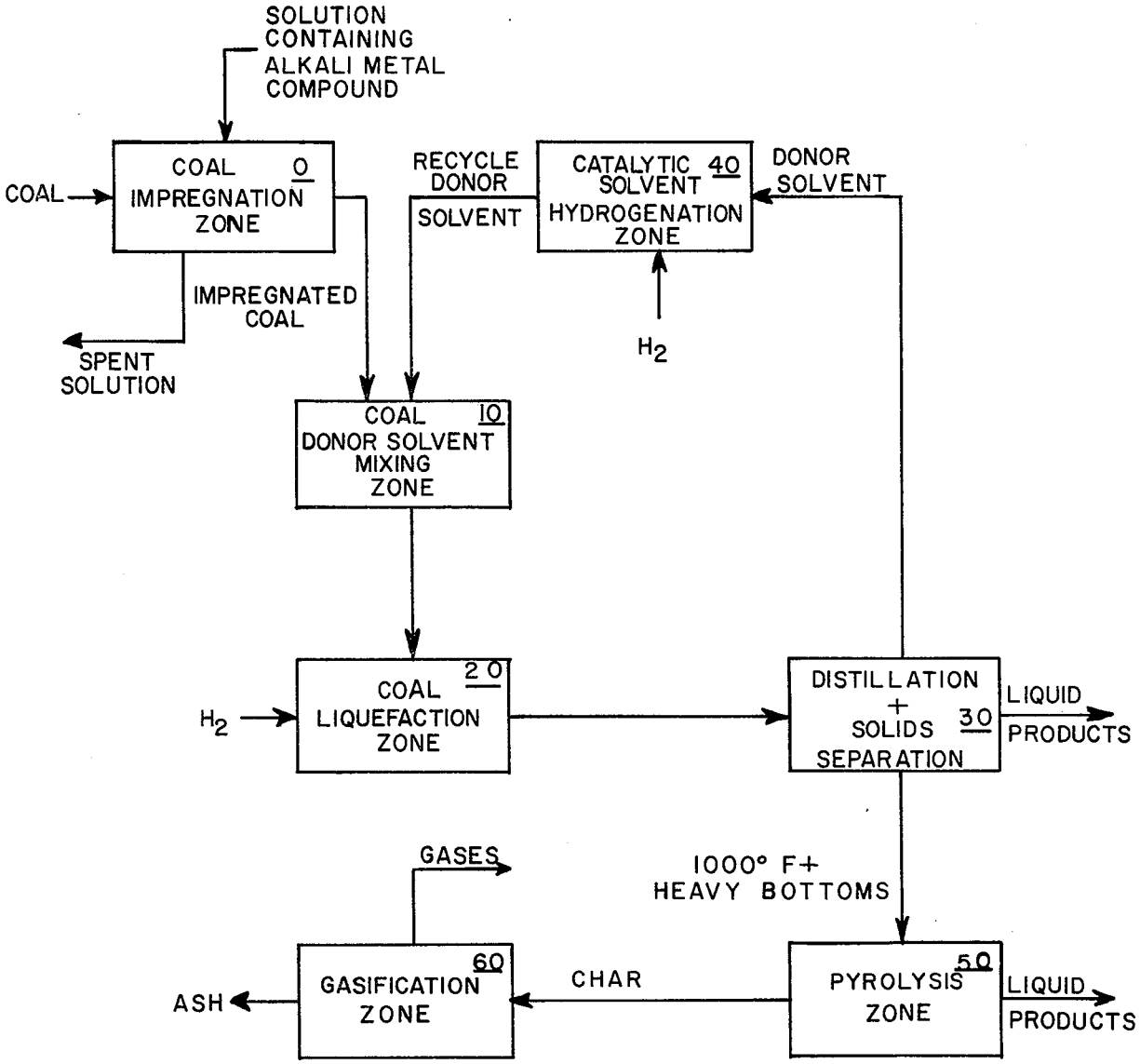
SOLUTION CONTAINING ALKALI METAL COMPOUND
COAL
COAL IMPREGNATION ZONE 0
IMPREGNATED COAL
SPENT SOLUTION
RECYCLE DONOR SOLVENT
CATALYTIC SOLVENT HYDROGENATION ZONE 40
DONOR SOLVENT
H2
COAL DONOR SOLVENT MIXING ZONE 10
H2
COAL LIQUEFACTION ZONE 20
DISTILLATION + SOLIDS SEPARATION 30
LIQUID PRODUCTS
GASES
1000° F+ HEAVY BOTTOMS
ASH
GASIFICATION ZONE 60
CHAR
PYROLYSIS ZONE 50
LIQUID PRODUCTS

LIQUEFACTION OF CALCIUM-CONTAINING SUBBITUMINOUS COALS AND COALS OF LOWER RANK

The Government of the U.S.A. has rights in this invention pursuant to Contract No. E(49-18)-2353 awarded by the U.S. Energy Research and Development Administration (ERDA).

It was known prior to the turn of the century that hydrocarbon gases and liquids, tars and chemicals could be obtained not only from petroleum, but from coal. Very early processes employed destructive distillation, coal being transformed into gases and petroleum-like liquid products. Other coal conversion processes involved the formation and extraction of a slurry with a hydrocarbon solvent, catalytic hydrogenation and hydrogenolysis. The use of coal liquids as refinery feedstocks and as petrochemical raw materials on commercial scale in this country now seems a virtual, or at least an eventual certainty in view of the demands now being made on petroleum reserves.

A coal liquefaction process of particular interest now under development is one which utilizes a hydrogen transfer, or hydrogen donor solvent to hydrogenate and liquefy the coal. In such process, crushed coal is contacted with a selective solvent which acts at least in part as a hydrogen donor to supply hydrogen to the hydrogen-deficient coal to convert the coal solids to liquids. The product includes petroleum-like liquids, i.e., 1000° F− liquids, and heavier products. The heavy products are characterized generally as "liquefaction bottoms," and consists of 1000° F+ organics, inorganics and carbon residue (fusinite). This material, which analyzes about 60–70 wt. % carbon, and about 20 wt. % ash, is less useful than the 1000° F− liquid, and generally contains 40–50 wt. % of the original feed coal to the process.

Coal is not a pure hydrocarbon, but is a material comprised of carbon, hydrogen, oxygen, sulfur and nitrogen. It contains a considerable amount of volatile matter. Principally, however, it is a material in which the organic matter makes up an essentially continuous phase within which mineral, or inorganic matter is dispersed. The organic material is comprised of bitumen and humin which have large, flat, aromatic, lamellar structures that differ in molecular weight, degree of aromaticity, oxygen, sulfur and nitrogen content and degree of crosslinking. Structurally, the organic portion of the coal is constituted of condensed aromatic rings of high molecular weight, about 70% of the carbon atoms being within the aromatic rings. Oxygen, sulfur and nitrogen are combined in chemically functional groups, e.g., hydroxyl, keto, carboxyl, amino, sulfide, and the like which occur in various parts of the molecules. The inorganic material consists of fusane, sulfur, e.g., pyritic sulfur and inorganic sulfates, and other mineral matter. Various metals, notably calcium is present as complexes of large organic acids known as humic acids; and perhaps, also as calcium ions.

The mineral matter in coal is not necessarily inert in coal liquefaction reactions; nor is its presence necessarily benign. The presence of calcium, in particular, as learned many decades ago by the Germans, is quite detrimental. At Wesseling, near Cologne, Germany, e.g. when the Germans operated a high pressure coal liquefaction process for producing liquids from lignites they found that their reactors all too rapidly plugged solid with a high ash-containing scale which they termed caviar, because it had the appearance of agglomerated balls, or spherulites. The spherulites, which are indictative of the vaterite form of calcium carbonate, were found to be comprised of calcium carbonate containing hexagonal crystals of iron sulfide. Deposits of the scale initially caused decreased production because of the necessity to lower throughput, and all too soon complete shutdown was necessary. Preheater tubes, on occasion, burst due to blockage. Attempts by the Germans to solve this problem largely involved engineering techniques to prevent scale formation. In one technique a small slip stream was withdrawn from an initial reactor of a series in a process called "desanding". The initially formed small particles were continuously withdrawn and removed, and the slip stream then returned to the reactor. This aided in suppressing further crystal growth, and slowed down the rate of scale formation within the reactor. This technique was subsequently abandoned due to high gas losses and high erosion rates within auxiliary equipment. In another method, a first reactor was provided with a concentric bottom mounted inlet tube through which the coal feed was introduced, an objective being to eliminate calcium carbonate growth in the product passed down stream. The problem of calcium carbonate scale formation yet persists resulting, inter alia, in intermittent operation. Further improvements are highly desirable in coal liquefaction processes to eliminate, or suppress, the formation of calcium carbonate scale in reactors, lines, and auxiliary equipment.

It is, accordingly, the primary objective of the present invention to supply this need.

A particular object is to provide a process for the pretreatment of calcium-containing subbituminous coals and coals of lower rank to render such coals amenable to liquefaction while suppressing the formation of calcium carbonate deposits as scale, within the coal liquefaction reactor, lines, and auxiliary equipment.

A more particular object of the invention is to provide a process of such character wherein the calcium is converted into a molecular species which is innocuous as regards the formation of scale, the calcium forming particulate residual solids, on liquefaction, that are easily disposed of with the coal liquefaction bottoms.

A further object is to provide, as an article of manufacture, a pretreated particulate calcium-containing coal feed which has been rendered amenable to liquefaction by pretreating to form therein a molecular species of calcium which lacks the normal tendency to form calcium carbonate scale within reactors, lines and auxiliary equipment at coal liquefaction conditions.

These objects and others are accomplished in accordance with the present invention characterized generally as a process for liquefying a coal feed, subsequent to a pretreatment, or preconditioning, of a subbituminous coal, or lower rank coal by contact with a compound or salt which forms an insoluble, thermally stable molecular species which remains as particulate solids within the residue, and within the liquefaction bottoms, on liquefaction of the coal. The added compound, or salt, reacts with the calcium of the coal to form a molecular species which deposits within the pores of the coal. The molecular species is thermally stable and does not decompose at liquefaction conditions, and during liquefaction it remains as particulate solids and thereby does not form, or it at least suppresses the formation of scale, or calcium carbonate deposits. The insoluble form of calcium remains within the liquefaction bottoms, and is conveniently disposed of, after liquefaction, with the liquefaction bottoms. Preferably, additional 1000° F− liquids are recovered from the liquefaction bottoms by pyrolysis in an additional step, and the 1000° F+ materials, or char, which now contains an alkali metal species is then subjected to gasification.

In the preferred practice of this invention, in a pretreatment step, within a solution, there is dispersed an alkali metal compound or salt, i.e., a compound or salt which is characterized by the formula MX, wherein M is a Group IA metal of the Periodic Table of the Elements (Sargent-Welch Scientific Company, Copyright 1968), suitably lithium, sodium, potassium, cesium, or the like, and X is an anion which is capable of forming insoluble, thermally stable calcium compounds, exemplary of which are sulfate, carbonate, phosphate, fluoride, molybdate and the like, and the solution, preferably an aqueous solution, is maintained in contact with a coal feed, suitably a particulate coal feed, for a period sufficient for impregnation of the alkali metal compound or salt into the pores of the coal, suitably for a period ranging at least about 0.01 hours to about 24 hours, preferably at least about 0.5 hours to about 4 hours. After the impregnation, the coal is removed from the aqueous soluton, and then liquefied at liquefaction conditions to produce petroleum-like liquid products.

The rate of impregnation of the coal depends to a large extent on coal particle size, and condition of the coal. In general, the smaller the particle size of the coal the greater the rate of impregnation, and conversely, the larger the particle size the slower the rate of impregnation. Generally, however, particulate coal of size ranging from about −8 mesh to about 1 inch particle size diameter, and more suitably from about −8 mesh to about 20 mesh (Tyler series), can be adequately impregnated within the above defined time periods by treatment, or contact with the aqueous solutions of the alkali metal compounds or salts, suitably by solutions containing from about 0.1 to about 20 percent, preferably from about 0.1 to about 10 percent of the alkali metal compounds or salts, based on the weight of the solution. Preferably, the coal is treated on an as received (or as mined) basis and is not dried prior to impregnation. In this regard it has been found that drying of the coal is deleterious in that it greatly reduces the amount of the compounds or salts which can be absorbed by the coal, and retards the rate of impregnation. It is believed that the drying causes the gel structure of the coal, and consequently the pores within the structure, to collapse. Also, when the coal is dried, the volume once occupied by water is displaced by gas; this decreasing considerably the ability of the solution with which the coal is contacted to wet the interior surface of the coal. The wetting properties of the pore surfaces are thus adversely affected on drying.

While Applicant does not desire to be bound by any specific theory of mechanism, the present invention is nontheless susceptible to reasonable explanation. Calcium is known to exist in coal largely as a humate, or organocalcium complex which presumably was introduced in nature via an ion exchange mechanism. Coal is thus a fossilized prehistoric form of plant life formed in the earth by partial decomposition, and gradual chemical transformation of vegetable matter under almost anerobic conditions, with the aid of microorganisms, and in the presence of water. Over the ages, as the ground water drained away the conversion of the plant matter took place, very slowly, leading first to the formation of lignite, then soft subbituminous coal, and then anthracite. During some early portion of this period, ground water percolated through the formation of coalifying, or coalified biomass, to deposit calcium. During normal liquefaction of the coal, it is the humates that are decomposed to calcium carbonate, this giving rise to scale formation, or deposits of calcium carbonate which form on reactor walls, lines, auxiliary equipment and the like. In accordance with Applicant's process, however, the calcium is precipitated internally within the pores of the coal as thermally stable molecular species, insoluble at liquefaction conditions, the calcium forming particulate residual solids which become a part of the liquefaction bottoms. The calcium, is thus separated after liquefaction from the valuable petroleum-like liquids as a portion of the liquefaction bottoms.

One thus visualizes the pores of mined coal as filled with water, and calcium humate as constituting a portion of the molecular structure of the coal. The calcium humate can thus be considered as comprised of two anionic sites, e.g., carboxylate and phenolate functional groups, one each of which projects outwardly into the liquid of the pore, and thus as having two electronegative groups which are counterbalanced by a $Ca^{2+}$ ion also contained in solution within the liquid of the pore. On addition of the alkali metal salt or compound, two of the alkali metal cations in effect replace the $Ca^{2+}$ ion and the anion, or X, combines with the calcium to form a molecular species which precipitates within the pore as insoluble CaX, a molecular species which is thermally stable and substantially inert at coal liquefaction conditions. The insoluble CaX forms a particulate solids species which remains as a part of the residue of the liquefaction bottoms, innocuous as to scale formation. Though the CaX species, however, is inert in the liquefaction reaction, the presence of the calcium is particularly beneficial where the liquefaction bottoms are to be gasified, since the calcium may constitute an effective gasification catalyst. In any event, the presence of the alkali metal unquestionably enhances the gasification reaction.

Improvements in gasification yields, and rates of conversion of the coal to gaseous products can also be obtained by the judicious selection of certain species of alkali metal compounds as opposed to others. For example, soluble compounds and salts wherein the cation portion thereof is cesium is more active than a compound or salt wherein the cation portion is potassium; and potassium is more active in a gasification reaction than sodium. Consequently, the cation can be selected on the basis of its activity, and cost effectiveness, in the selection of an alkali metal compound or salt, particularly inasmuch as there is no impairment or loss in the function of the anion in forming the insoluble molecular species, CaX. Potassium and sodium are preferred cations for use in the formation of the insoluble CaX species from a cost-effectiveness point of view. The preferred soluble alkali metal compounds and salts are those which contain a sulfate, or carbonate, either of which forms an insoluble molecular species comprised of $CaSO_4$ or $CaCO_3$. Exemplary of species which contain both a preferred cation and anion for such purposes are sodium sulfate, potassium sulfate, potassium carbonate and the like. Generally, in the treatment of a subbituminous coal or coal of lower rank essentially 80 to 100 percent of the $Ca^{2+}$ ions originally present in a coal can be converted into an insoluble thermally stable CaX molecular species, particularly to $CaSO_4$ or $CaCO_3$ which remains within the coal and is released during liquefaction as particulate solids which are recovered with the liquefaction bottoms. And, this can be accomplished with an undried coal at ambient, or essentially ambient conditions without any necessity of heating the solution or supplying a vacuum, though a vacuum can be used to increase the rate of impregnation of a dried coal if desired.

DRAWING DESCRIPTION

The drawing consists of a flow chart block diagram of the coal liquefaction process.

In the best mode of practicing the present invention, a subbituminous or lower rank coal feed is contacted at ambient conditions with a solution of an alkali metal compound or salt as characterized by the formula MX, supra, and impregnated. The solution is then separated from the coal as by centrifugation or filtering, and if desired, the coal can then be reduced in size (if not previously done) and then dried. In such process, schematically illustrated by reference to the figure, the required process steps generally include (a) a first zone 0 wherein coal, suitably particulate coal, is contacted with a solution of an alkali metal compound or salt, then separated from the solution and dried (by additional steps not shown), (b) a mixing zone 10 within which the particulate impregnated coal is slurried with an internally generated or indigenous liquids fraction, (c) a coal liquefaction zone 20 within which a slurry of the impregnated coal and hydrogen are fed, and the coal liquefied, (d) a distillation and solids separation zone 30 within which a solvent fraction, a 1000° F.+ heavy bottoms fraction, and liquid product fraction are separated, (e) a catalytic solvent hydrogenation zone 40 wherein the solvent fraction is hydrogenated prior to its being recycled to said coal liquefaction zone 20, (f) a pyrolysis zone 50 wherein the 1000° F.+ heavy bottoms fraction from zone 30 can be pyrolyzed to produce additional 1000° F.− liquids, and char, and (g) a gasification zone 60 wherein the char can be gasified in a catalytic reaction.

In coal impregnation zone 0, a particulate subbituminous or lower rank coal of size ranging up to about ⅛ inch particle size diameter, suitably 8 mesh (Tyler), is slurried in an aqueous solution containing an alkali metal compound or salt, as previously characterized, e.g., $Na_2SO_4$, $K_2SO_4$ or the like, added to the water in concentrations ranging from about 1 to about 20 weight percent, preferably from about 1 to about 10 weight percent, at ambient conditions for a period of about 30 minutes to 2 hours. Thereafter, the impregnated coal is separated from the coal by filtration, and dried.

The impregnated coal is then admixed in zone 10 with a recycle donor solvent. The total solvent and coal are admixed in a solvent-to-coal ratio ranging from about 0.8:1 to about 4:1, preferably about 1.2:1 to about 1.6:1, based on weight. The solvent is one which boils within the range of about 250° F. to about 850° F., preferably from about 290° F. to about 700° F. The coal slurry is then fed, preferably with molecular hydrogen, into the coal liquefaction zone 20.

Within the coal liquefaction zone 20, liquefaction conditions include a temperature ranging from about 700° F. to about 950° F., preferably from about 800° F. to about 850° F., with pressures ranging from about 300 psia to about 3000 psia, preferably from about 800 psia to about 2000 psia. Preferably molecular hydrogen is also added to the liquefaction zone 20 at a rate from about 1 to about 6 weight percent (MAF coal basis), liquid residence times ranging from about 5 to about 130 minutes, and preferably from about 10 to about 60 minutes.

The product from the coal liquefaction zone 20 consists of gases and liquids, the liquids comprising a mixture of undepleted hydrogen-donor solvent, depleted hydrogen-donor solvent, or compounds, dissolved coal, undissolved coal and mineral matter. The liquid mixture is transferred into a separation zone 30 wherein light fractions boiling below 400° F. useful as fuel gas or naphtha are recovered, and intermediate fractions boiling, e.g., from 400° F. to 700° F. are recovered for use as a hydrogen donor solvent. Heavier fractions boiling from about 700° F. to 1000° F. are also recovered, and bottoms fractions boiling above 1000° F., including char, mineral matter and ash are withdrawn for use in a gasification process or for coking, as desired.

The solvent fraction, or 400°–700° F. fraction, is introduced into a catalytic solvent hydrogenation zone 40 to upgrade the hydrogen content of that fraction. The conditions maintained in hydrogenation zone 40 hydrogenate and, if desired, conditions can be provided which produce substantial cracking. Temperatures normally range from about 650° F. to about 850° F., preferably from about 700° F. to about 800° F., and pressures suitably range from about 650 psia to about 2000 psia, preferably from about 1000 psia to about 1500 psia. The hydrogen treat rate ranges generally from about 1000 to about 10,000 SCF/B, preferably from about 2000 to about 5000 SCF/B. The hydrogenation catalysts employed are conventional. Typically, such catalysts comprise an alumina or silica-alumina support carrying one or more Group VIII non-noble, or iron group metals, and one or more Group VI-B metals of the Periodic Table. In particular, combinations of one or more Group VI-B metal oxides or sulfides with one or more Group VIII metal oxides or sulfides are preferred. Typical catalyst metal combinations include oxides and/or sulfides of cobalt-molybdenum, nickel-molybdenum, nickel-tungsten, nickel-molybdenum-tungsten, cobalt-nickel-molybdenum and the like. A suitable cobalt molybdenum catalyst is one comprising from about 1 to about 10 weight percent cobalt oxide and from about 5 to about 40 weight percent molybdenum oxide, especially about 2 to 5 weight percent cobalt and about 10 to 50 weight percent molybdenum. Methods for the preparation of these catalysts are well known in the art. The active metals can be added to the support or carrier, typically alumina, by impregnation from aqueous solutions followed by drying and calcining to activate the composition. Suitable carriers include, for example, activated alumina, activated alumina-silica, zirconia, titania, etc., and mixtures thereof. Activated clays, such as bauxite, bentonite and montmorillonite, can also be employed.

(f) Suitably, the 1000° F.+ liquid bottoms from zone 30 is next pyrolyzed in a pyrolysis zone 50 and pyrolyzed at temperatures ranging from about 900° F. to about 2200° F., preferably from about 900° F. to about 1200° F., at pressures ranging from about ambient to about 200 psig, preferably from about 10 psig to about 150 psig, to recover additional 1000° F.− liquids, and the 1000° F.+ material, or char, is then sent to a gasification zone 60.

(g) The residual 1000° F.+ material, or char, is gasified with steam in zone 60 at temperatures ranging from about 900° F. to about 1800° F., preferably from about 1200° F. to about 1500° F., at pressures ranging from about ambient to about 200 psig, preferably from about 10 psig to about 150 psig, to recover gaseous products, carbon monoxide, hydrogen and the like.

These and other features of the present invention will be better understood by reference to the following demonstrations of prior art runs conducted by liquefaction of the coal without benefit of treatment with the alkali metal compounds and salts of this invention, and to comparative data showing liquefaction of coal pretreated with alkali metal compounds and salts in accordance with this invention. Comparative data are also given which show the gasification of char obtained from untreated coal, and coal pretreated pursuant to this invention. All units are in terms of weight unless otherwise specified.

EXAMPLES 1-2

Two fifty gram portions of −20 mesh Wyodak coal (Sample Nos. 1 and 2), on an as received basis and containing 30 weight percent moisture, were each contacted and immersed, respectively, in a 150 ml. portion of a solution, (a) one of which was formed by dissolving 5 grams of $K_2CO_3$ in 250 ml. of distilled water, and (b) the other of which was formed by dissolving 5 grams $K_2SO_4$ in 250 ml. of distilled water. Each of the two portions of coal were allowed to stand for a 24 hours period, after which time the portions of coal were separated by filtration from the two different solutions, washed with distilled water and then dried in a vacuum oven at about 220° F.

Five gram portions from each of the two larger portions of alkali-metal salt treated coal specimens, and a third five gram specimen of −20 mesh as received, or untreated (raw) Wyodak coal (Sample NO. 0), similarly dried, were then each separately admixed, or slurried with 10 grams of tetralin in a tubing bomb. Hydrogen was then added to each tubing bomb, and each bomb sealed at 400 psig.

The bombs were then placed in a sandbath heated to 770° F. for a period of 1 hour and 45 minutes to liquefy the specimens of coal. The bombs were then rapidly quenched in cold water. In a series of separate manipulations, each of the bombs were then separately opened and the contents of each poured into cyclohexane, washed with hexane, and the washings combined with the rest of the cyclohexane. After the several washings, the cyclohexane specimens were centrifuged, and the recovered solids washed several times with additional hexane taking care in each instance to recover as much of the solids as possible. These manipulations completed, the three solid specimens were dried in a vacuum oven at 220° F. Ash analyses were then obtained, from which the conversion for each specimen was then calculated. The present conversion of each specimen of coal to 1000° F.− liquid is given in Table I, below.

TABLE I

| Sample No. | Specimen | Percent Conversion to 1000° F. - Coal Liquids[1] |
|---|---|---|
| 0 | Raw Wyodak Coal | 70.0 |
| 1 | $K_2CO_3$ Treated Wyodak Coal | 74.1 |
| 2 | $K_2SO_4$ Treated Wyodak Coal | 63.3 |

[1]Average of two runs.

Analyses, after completion of the liquefaction, showed the presence of vaterite in the residue from the raw, or untreated coal. No vaterite was found in the residue from either of the other specimens.

Atomic absorption analyses showed that 0.023 mole of $K_2CO_3$ was absorbed onto 100 grams of as received Wyodak coal, whereas, in contrast, only 0.009 mole of $K_2SO_4$ was absorbed on a similar specimen of Wyodak coal. This reflects the importance of the solubility of the anion, i.e., $CO_3^{--}$ vis-a-vis $SO_4^{--}$, to wit:

$$Ca^{+2} + K_2X = K_2^{+} + CaX$$

where $X = SO_4^{=}$, solubility of $CaSO_4$ is 0.2g./100 ml.
$X = CO_3^{=}$, solubility of $CaCO_3$ is 0.0014g./100 ml.

The greater insolubility of $CaCO_3$ drives the exchange equilibrium, as shown by the equation, to the right, giving more potassium incorporation.

Next, 80 milligram specimens of each of the three samples obtained from the liquefaction residue, respectively, were placed in a thermogravimetric analyzer, then heated to about 1560° F. until a constant weight was obtained.

Steam was then introduced, and the weight change was measured with time. These data were used to calculate instantaneous rates of gasification vis-a-vis % burnoff. The data are shown in Table II, below:

TABLE II

| | Char Gasification Rates at 1560° F. | | |
|---|---|---|---|
| Sample No. | Percent Volatile Before Steam Added[1] | Percent Burnoff[1] | Instantaneous Rate mg/min./mg[1] |
| 0 | 32.9 | 8.9 | 0.203 |
| | | 29.4 | 0.170 |
| | | 50.2 | 0.057 |
| 1 ($K_2CO_3$) | 26.3 | 7.9 | 0.383 |
| | | 23.6 | 0.460 |
| | | 47.7 | 0.391 |
| 2 ($K_2SO_4$) | 28.9 | 8.6 | 0.148 |
| | | 30.3 | 0.153 |
| | | 49.4 | 0.126 |

[1]Average of two runs.

These data thus show that the alkali metal cations are carried through and are contained within the 1000° F.− liquefaction bottoms. Where a sufficient amount of the alkali metal cations are present additional 1000° F.− liquids can be produced and then, on gasification the cations can act as catalysts in the gasification reaction to increase the reaction rate, as compared with untreated coal. The advantage gained, if desired, could be translated into lower gasification temperatures. Suitably also, the catalyst can be recovered by existing technology and recycled.

It is apparent that various modifications can be made without departing the spirit and scope of the invention. Various analyses, taken together, suggest that coal contains a limited number of exchange sites, and that under varying conditions of time, concentration, and solution to coal ratio, the exchange of the metal salts into the coal can be substantially quantitative. Essentially all of the calcium of a subbituminous or coal of lower rank, if it is not dried prior to treatment, can thus be converted to a form of calcium which is essentially innocuous in the coal liquefaction reaction, and the calcium which remains in the coal may be beneficial in a coal gasification reaction. Moreover, by judicious selection of a metal cation species which is catalytic the performance of the coal gasification process can be improved; and by selection of cations on the basis of their cost and effectiveness in catalyzing the gasification reaction considerable improvements can be made from a cost-effectiveness standpoint.

Having described the invention what is claimed is:

1. A process for the treatment of calcium-containing subbituminous coals and coals of lower rank to form an insoluble, thermally stable calcium salt which does not form a scale during coal liquefaction consisting essentially of dispersing and forming a solution of an alkali metal compound or salt characterized by the formula MX, wherein M is a Group IA metal of the Periodic Table of the Elements, and X is an anion which is capable of forming a water insoluble, thermally stable calcium compound, contacting said coal and said solution, maintaining contact between said coal and said solution of said alkali metal compound or salt for a period sufficient for impregnation of said compound or salt into the pores of the coal such that alkali metal cations replace at least a portion of the $Ca^{2+}$ ion and the anion, X, combines with the $Ca^{2+}$ ion thus replaced to form a molecular species which precipitates within the pore as insoluble CaX, separating said impregnated particulate coal from said solution, and then liquefying said impregnated coal at liquefaction conditions to produce petroleum-like liquid products.

2. The process of claim 1 wherein X is an anion selected from the group consisting of sulfate, carbonate, phosphate, fluoride and molybdate.

3. The process of claim 2 wherein M, of the compound or salt characterized by the formula MX, is lithium.

4. The process of claim 2 wherein M, of the compound or salt characterized by the formula MX, is sodium.

5. The process of claim 2 wherein M, of the compound or salt characterized by the formula MX, is potassium.

6. The process of claim 2 wherein M, of the compound or salt characterized by the formula MX, is cesium.

7. The process of claim 2 wherein X, of the compound or salt characterized by the formula MX, is sulfate.

8. The process of claim 2 wherein X, of the compound or salt characterized by the formula MX, is carbonate.

9. The process of claim 2 wherein X, of the compound or salt characterized by the formula MX, is phosphate.

10. The process of claim 2 wherein X, of the compound or salt characterized by the formula MX, is fluoride.

11. The process of claim 2 wherein X, of the compound or salt characterized by the formula MX, is molybdate.

12. The process of claim 2 wherein contact between the particulate coal and the solution of the salt or compound is maintained for a period ranging at least about 0.01 to about 24 hours.

13. The process of claim 2 wherein the coal is liquefied in a liquefaction zone at temperatures ranging from about 700° F. to about 950° F., at pressure ranging about from about 300 psia to about 3000 psia by contact with a hydrogen donor solvent.

14. The process of claim 13 wherein the temperature of liquefaction ranges from about 800° F. to about 850° F., and the pressure ranges from about 800 psia to about 2000 psia.

15. The process of claim 13 wherein the hydrogen donor solvent is one which boils within a range of from about 400° F. to about 850° F., and contains at least about 30 wt. % hydrogen donor compounds.

* * * * *